US008745853B2

(12) United States Patent
Grbic et al.

(10) Patent No.: US 8,745,853 B2
(45) Date of Patent: Jun. 10, 2014

(54) ANTENNA FABRICATION WITH THREE-DIMENSIONAL CONTOURED SUBSTRATES

(75) Inventors: Anthony Grbic, Ann Arbor, MI (US); Carl Pfeiffer, Milford, MI (US); Xin Xu, West Windsor, NJ (US); Stephen Forrest, Ann Arbor, MI (US)

(73) Assignees: Universal Display Corporation, Ewing, NJ (US); The Regents of the University of Michigan, University of Michigan Office of Technology Transfer, Ann Arbor, MI (US)

( * ) Notice: Subject to any disclaimer, the term of this patent is extended or adjusted under 35 U.S.C. 154(b) by 253 days.

(21) Appl. No.: 13/176,053

(22) Filed: Jul. 5, 2011

(65) Prior Publication Data

US 2012/0007791 A1 Jan. 12, 2012

Related U.S. Application Data

(60) Provisional application No. 61/361,446, filed on Jul. 5, 2010.

(51) Int. Cl.
*H01P 11/00* (2006.01)

(52) U.S. Cl.
USPC ..... 29/600; 343/700 MS

(58) Field of Classification Search
USPC ..... 29/600–601, 830–832, 729, 739, 848, 29/827; 343/700 MS, 786, 895
See application file for complete search history.

(56) References Cited

U.S. PATENT DOCUMENTS

| | | | | |
|---|---|---|---|---|
| 5,200,756 | A * | 4/1993 | Feller | 343/700 MS |
| 5,815,122 | A * | 9/1998 | Nurnberger et al. | 343/767 |
| 6,020,862 | A * | 2/2000 | Newton et al. | 343/872 |
| 6,246,381 | B1 * | 6/2001 | VandenDolder et al. | 343/912 |
| 6,396,444 | B1 * | 5/2002 | Goward et al. | 343/702 |
| 6,531,983 | B1 * | 3/2003 | Hirose et al. | 343/700 MS |
| 2012/0007791 | A1 * | 1/2012 | Grbic et al. | 343/895 |

OTHER PUBLICATIONS

Xu et al., "Direct Transfer Patterning on Three Dimensionally Deformed Surfaces at Micrometer Resolutions and its Application to Hemispherical Focal Plane Detector Arrays," Organic Electronics 9, pp. 1122-1127 (2008).

Best, "The radiation properties of electrically small folded spherical helix antennas," IEEE Transactions on Antennas and Propagation, vol. 52, No. 4, pp. 953-960 (Apr. 2004).

(Continued)

*Primary Examiner* — Minh Trinh

(74) *Attorney, Agent, or Firm* — Lempia Summerfield Katz LLC

(57) ABSTRACT

Disclosed herein is a method of fabricating an antenna in which a flexible stamp is formed from a first wafer, the first wafer transferring a pattern to the flexible stamp, in which an antenna substrate is shaped into a three-dimensional contour with a second mold, in which the flexible stamp is positioned in the second mold to deform the flexible stamp into the three-dimensional contour, and in which a metallic layer on the flexible stamp is cold welded to create a set of antenna traces on the antenna substrate in accordance with the pattern. The antenna traces may then be electroplated.

13 Claims, 9 Drawing Sheets

(56) References Cited

OTHER PUBLICATIONS

Erentok et al., "Metamaterial-Inspired Efficient Electrically Small Antennas," IEEE Transactions on Antennas and Propagation, vol. 56, No. 3, pp. 691-707 (Mar. 2008).

Stuart et al., "Small Spherical Antennas Using Arrays of Electromagnetically Coupled Planar Elements," IEEE Antennas and Wireless Propagation Letters, vol. 6, No. 1, pp. 7-10 (Jul. 2007).

Best, "On the performance properties of the Koch fractal and other bent wire monopoles," IEEE Transactions on Antennas and Propagation, vol. 51, No. 6, pp. 1292-1300 (Jun. 2003).

Chu, "Physical limitations of omni-directional antennas," Journal of Applied Physics, vol. 19, pp. 1163-1175 (Dec. 1948).

McLean, "A re-examination of the fundamental limits on the radiation Q of electrically small antennas," IEEE Transactions on Antennas and Propagation, vol. 44, No. 5, pp. 672-676 (May 1996).

* cited by examiner

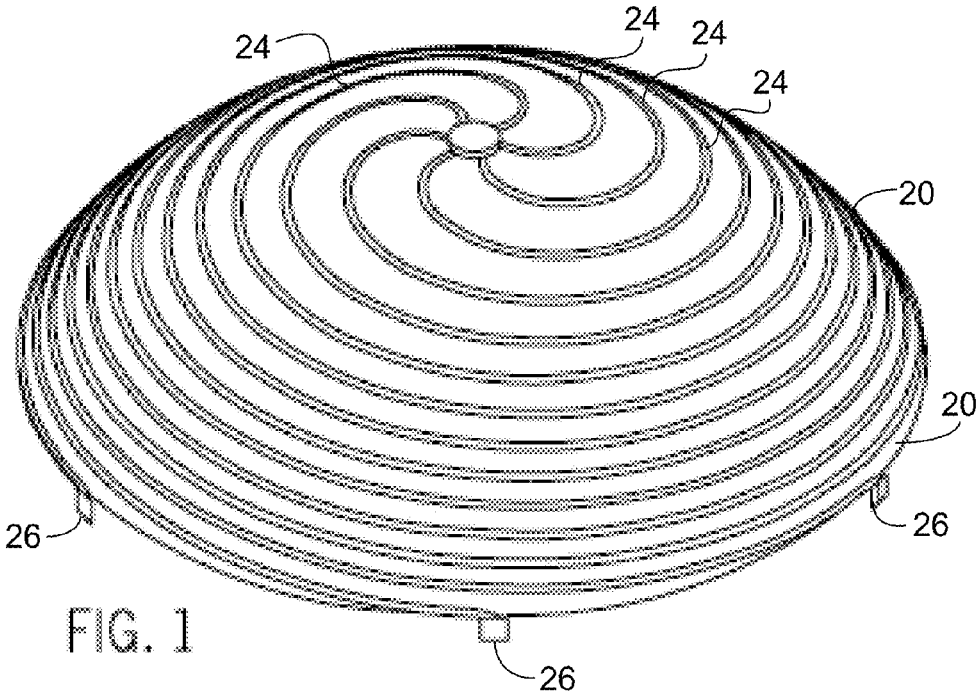
FIG. 1
FIG. 2
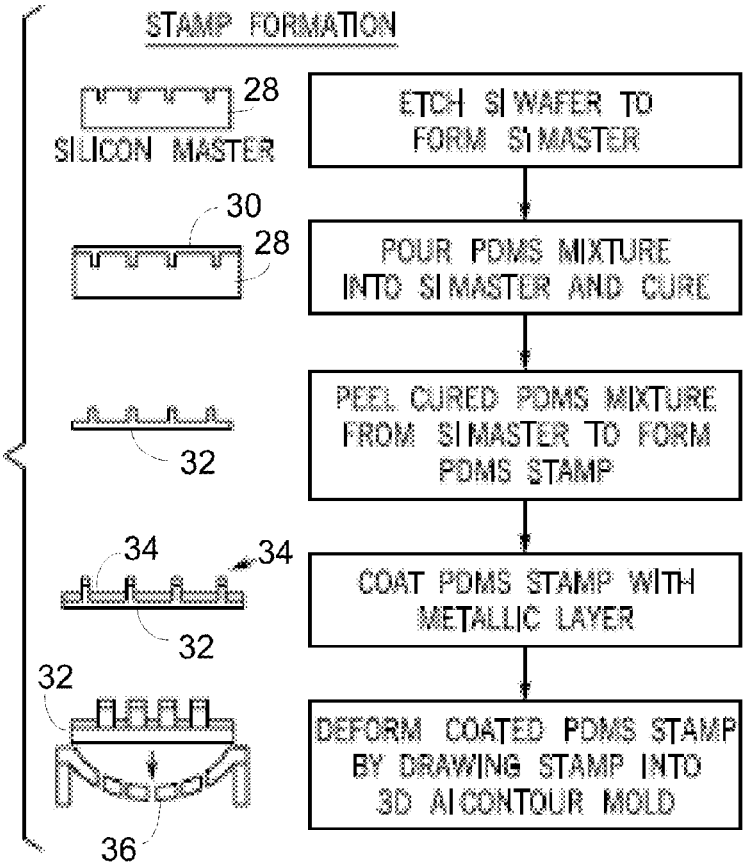

ANTENNA FABRICATION WITH THREE-DIMENSIONAL CONTOURED SUBSTRATES

CROSS-REFERENCE TO RELATED APPLICATION

This application claims the benefit of U.S. provisional application entitled "Antenna Fabrication with Three-Dimensional Contoured Substrates," filed Jul. 5, 2010, and assigned Ser. No. 61/361,446, the entire disclosure of which is hereby expressly incorporated by reference.

STATEMENT REGARDING FEDERALLY SPONSORED RESEARCH OR DEVELOPMENT

This invention was made with government support under Contract No. ECCS-0747623 awarded by the National Science Foundation, and under Contract No. FA9550-06-01-0279 awarded by the Air Force Office of Scientific Research. The government has certain rights in the invention.

JOINT RESEARCH AGREEMENT

The claimed invention was made by, on behalf of, or in connection with one or more of the following parties to a joint university-corporation research agreement: the Regents of the University of Michigan, Princeton University, The University of Southern California, and Universal Display Corporation. The agreement was in effect on and before the date the claimed invention was made, and the claimed invention was made as a result of activities undertaken within the scope of the agreement.

BACKGROUND OF THE DISCLOSURE

1. Field of the Disclosure

The disclosure relates generally to antennas and, more particularly, to the fabrication of electrically small antennas on three-dimensionally contoured substrates.

2. Brief Description of Related Technology

With the expansion of the wireless mobile market, interest in electrically small antennas has surged in recent years. See, for example, Best, "The radiation properties of electrically small folded spherical helix antennas," IEEE Transactions on Antennas and Propagation, vol. 52, no. 4, pp. 953-960 (April 2004), and Erentok et al., "Metamaterial-Inspired Efficient Electrically Small Antennas," IEEE Transactions on Antennas and Propagation, vol. 56, no. 3, pp. 691-707 (March 2008). In many cases, the size of the antenna limits the minimum achievable size of the wireless device itself.

A common method of making an efficient electrically small antenna is to use a small dipole antenna in combination with a matching circuit. This approach generally leads to very narrow bandwidths and relatively low efficiencies. Other methods include packing resonant, magnetically coupled antenna elements into a small volume, and using space filling curve antennas and fractal curve antennas. Please see, for example, Stuart et al., "Small Spherical Antennas Using Arrays of Electromagnetically Coupled Planar Elements," IEEE Antennas and Wireless Propagation Letters, vol. 6, no. 1, pp. 7-10 (July 2007), and Best, "On the performance properties of the Koch fractal and other bent wire monopoles," IEEE Transactions on Antennas and Propagation, vol. 51, no. 6, pp. 1292-1300 (June 2003).

Antennas are considered to be electrically small when their maximum radial dimension (ka) is less than 0.5 radians, where $k=2\pi/\lambda$ is the free space wave number, and a is the radius of the minimum sphere which circumscribes the antenna. Maximizing an antenna's bandwidth is equivalent to minimizing its quality factor (Q). It has been shown that the minimum achievable Q factor for electrically small antennas is $Q_{chu}=1/(ka)+1/(ka)^3$. Please see Chu, "Physical limitations of omni-directional antennas," Journal of Applied Physics, vol. 19, pp. 1163-1175 (December 1948), and McLean, "A re-examination of the fundamental limits on the radiation Q of electrically small antennas," IEEE Transactions on Antennas and Propagation, vol. 44, no. 5, pp. 672-676 (May 1996). The ratio of an antenna's Q to $Q_{chu}$ is a common figure of merit for characterizing small antennas.

Spherical helix antennas have been shown to closely approach the Chu limit. Spiraled metallic wires in the shape of a hemisphere have been formed by manually bending the metallic wire around a sphere. Unfortunately, the manual nature of that step has made fabrication of these antennas time consuming, inaccurate and expensive.

SUMMARY OF THE DISCLOSURE

In accordance with one aspect of the disclosure, a method of fabricating an antenna includes forming a flexible stamp from a first mold, the first mold transferring a pattern to the flexible stamp, shaping an antenna substrate into a three-dimensional contour with a second mold, positioning the flexible stamp in the second mold to deform the flexible stamp into the three-dimensional contour, and cold welding a metallic layer on the flexible stamp to create a set of antenna traces on the antenna substrate in accordance with the pattern.

The method may further include etching unwanted metal disposed between the antenna traces.

The antenna substrate may include glass, glycol-modified polyethylene terephthalate (PETg), or other dielectric material.

The method may also include electroplating the metallic layer to thicken the antenna traces. Electroplating the metallic layer may include pulse plating. The metallic layer on the flexible stamp may include gold. Alternatively or additionally, electroplating the metallic layer includes depositing copper onto the gold.

The first mold may include a wafer. Alternatively or additionally, the second mold includes a vacuum mold.

Cold welding the metallic layer may include applying the metallic layer to a metallic strike layer on the antenna substrate. The method may further include sputtering Silicon dioxide onto a surface of the antenna substrate before deposition of the metallic strike layer. Alternatively, the method further includes sputtering Silicon dioxide and copper onto a surface of the antenna substrate before deposition of the metallic strike layer.

In accordance with another aspect of the disclosure, an antenna includes a dielectric substrate having a three-dimensional contour and a set of antenna traces on the dielectric substrate. Each antenna trace spirals around the three-dimensional contour in a helical pattern. Each antenna trace includes a plated metallic layer.

The dielectric substrate may be shaped as a spherical shell. In some of these cases, the dielectric substrate is shaped as a hemispherical shell or as part of a hemispherical shell.

The dielectric substrate may be configured such that the antenna is an electrically small antenna.

The plated metallic layer may include plated copper. Alternatively or additionally, the plated metallic layer has a thickness greater than 1 μm.

BRIEF DESCRIPTION OF THE DRAWING FIGURES

For a more complete understanding of the disclosure, reference should be made to the following detailed description and accompanying drawing figures.

FIG. 1 is a perspective view of an exemplary helix antenna printed onto an upper half of a hemispherical dielectric substrate or shell in accordance with one or more aspects of the disclosure.

FIG. 2 is a schematic illustration of a process flow for preparing an exemplary stamp in accordance with one or more aspects of the disclosure. The illustration includes a flow diagram of fabrication acts taken to form the structures shown in cross-sectional schematic views. Each block of the flow diagram is shown alongside a respective cross-sectional schematic view of the structure formed by the act(s) of the block.

FIG. 3 is a schematic illustration of a process flow for preparing an exemplary three-dimensionally (3D) contoured antenna substrate in accordance with one or more aspects of the disclosure. The illustration includes a flow diagram of fabrication acts taken to form the structures shown in cross-sectional schematic views. Each block of the flow diagram is shown alongside a respective cross-sectional schematic view of the structure formed by the act(s) of the block.

FIG. 4 is a schematic illustration of an exemplary stamping process flow in accordance with one or more aspects of the disclosure. The illustration includes a flow diagram of fabrication acts taken to form the structures shown in cross-sectional schematic views. The blocks of the flow diagram may be shown alongside respective cross-sectional schematic views of the structure formed by the act(s) of the block.

FIG. 5 is a schematic illustration of exemplary etching and plating steps of the disclosed fabrication processes in accordance with one or more aspects of the disclosure. The illustration includes a flow diagram of fabrication acts taken to form the structures shown in cross-sectional schematic views. Each block of the flow diagram is shown alongside a respective cross-sectional schematic view of the structure formed by the act(s) of the block.

Figure 10:
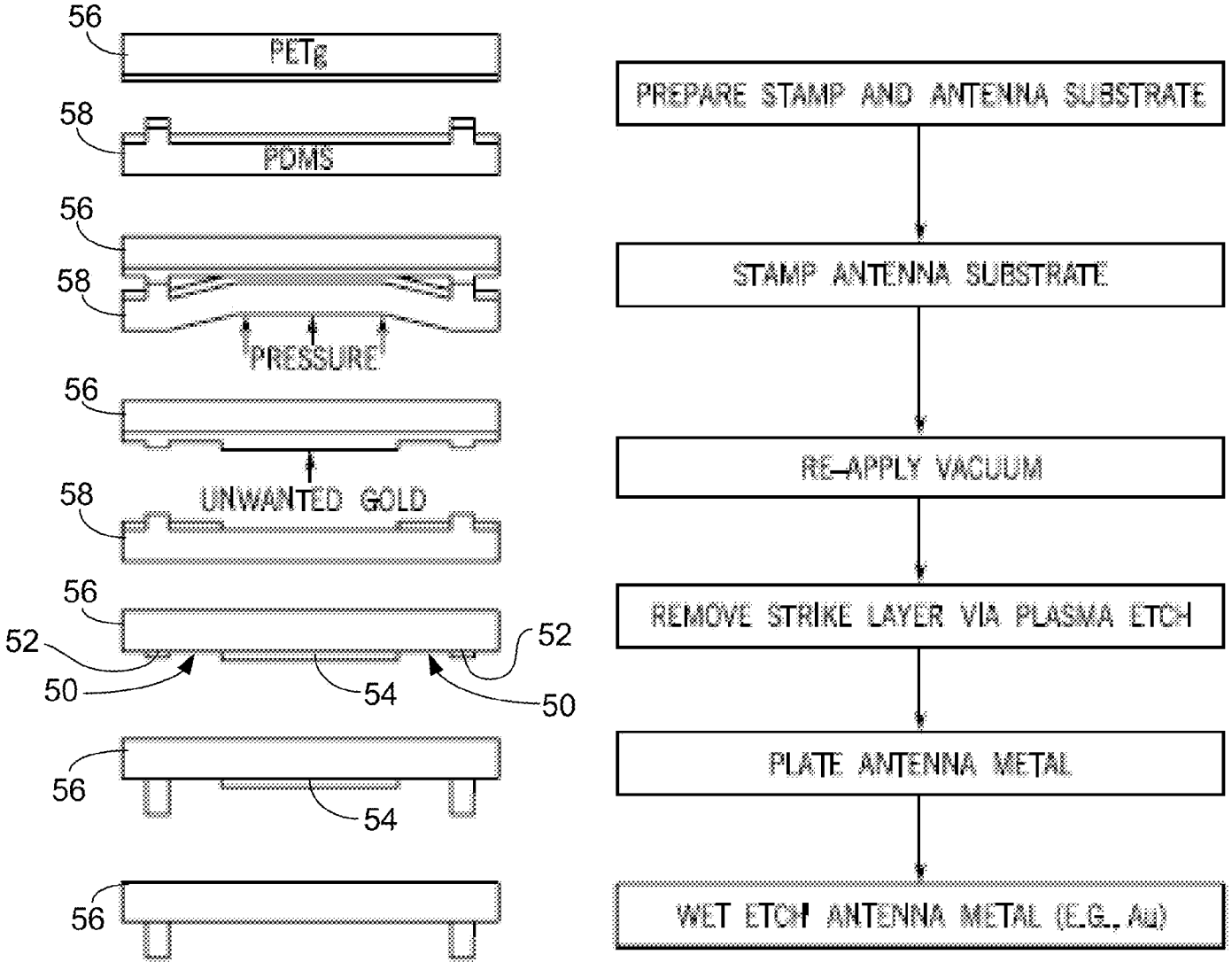

FIG. 10 is a schematic illustration of an exemplary process flow to address antenna designs having large spaces between traces by removal of any resulting extra gold via a wet etch step (e.g., a wet gold (Au) etch process) in accordance with one or more aspects of the disclosure. The illustration includes a flow diagram of fabrication acts taken to form the structures shown in cross-sectional schematic views. Each block of the flow diagram is shown alongside a respective cross-sectional schematic view of the structure formed by the act(s) of the block.

Figure 11A:
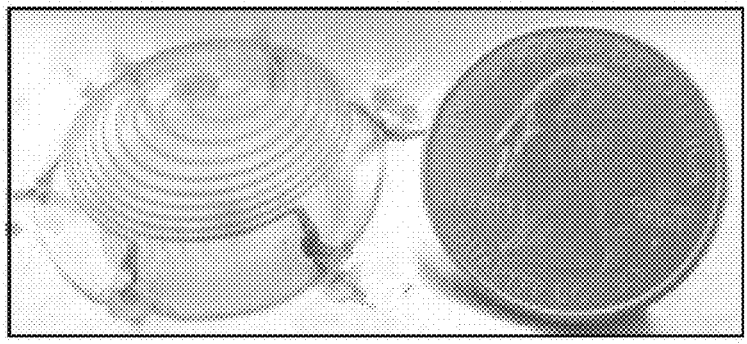
Figure 11B:
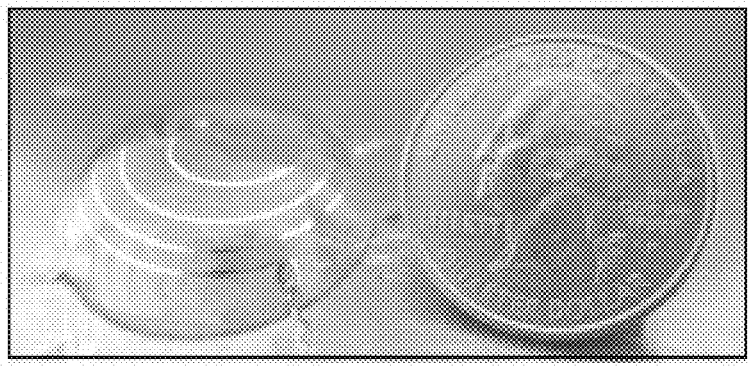

FIGS. 11A and 11B are photographs of examples of antennas fabricated via the disclosed methods on half hemisphere substrates. The antennas are depicted alongside a quarter to show relative size.

Figure 12A:
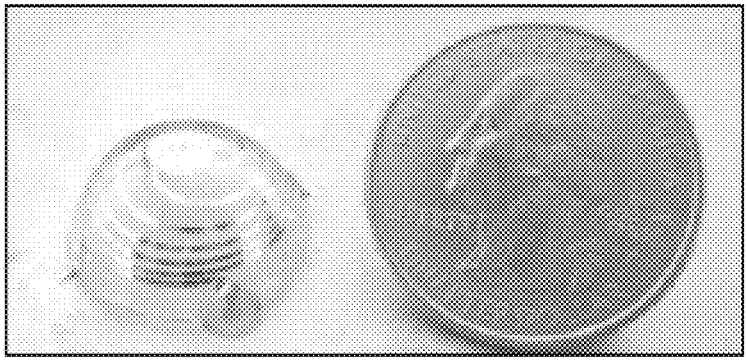
Figure 12B:
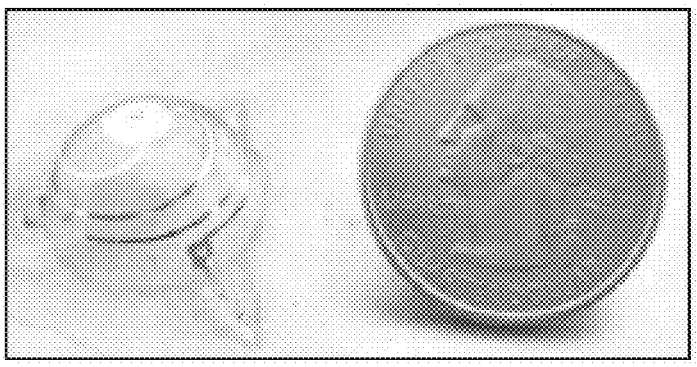

FIGS. 12A and 12B are photographs of examples of antennas fabricated via the disclosed methods on full hemisphere substrates. The antennas are depicted alongside a quarter to show relative size.

While the disclosed antennas and antenna fabrication processes are susceptible of embodiments in various forms, there are illustrated in the drawing (and will hereafter be described) specific embodiments of the invention, with the understanding that the disclosure is intended to be illustrative, and is not intended to limit the invention to the specific embodiments described and illustrated herein.

DETAILED DESCRIPTION OF THE DISCLOSURE

The disclosure generally relates to the fabrication of printed antennas onto three-dimensionally (3D) contoured substrates. As described below, the disclosed processes are directed to fabricating electrically small and contoured antennas via direct transfer patterning techniques that print metallic traces onto a 3D-contoured, dielectric substrate.

The disclosed processes are capable of feature sizes as small as approximately 1 μm despite printing onto arbitrarily contoured substrates. The feature size limits may decrease, as the accuracy of the disclosed printing processes is determined only by the photolithographic process used to etch grooved patterns onto silicon wafers. As described below, the disclosed processes may be implemented to accurately fabricate a variety of different metal patterns to generally address the challenges presented by electrically small antennas and contoured antennas.

Several challenges are typically encountered in connection with the design and fabrication of electrically small dipole antennas. At the outset, their radiation resistance is generally low ($<<50\Omega$) and their input reactance is generally large. These characteristics may lead to a poorly matched and inefficient antenna. However, spherical helix antennas exhibit added inductance that allows them to resonate while still maintaining a small electrical size. The inductance of spherical helix antennas is increased by spiraling the wire around a sphere to increase the total wire length without affecting overall size.

One of the antenna shapes that may be fabricated via the disclosed direct transfer patterning processes is the spherical helix. The design and fabrication of electrically small, printed spherical helical antennas using 3D contoured substrates are described below. In one case, an antenna designed to operate at about 1 GHz (e.g., 0.78 GHz) has six helical, gold arms printed onto a hemispherical substrate. In one example of that configuration, the minimum radius sphere that circumscribes the antenna is 1.73 cm, which results in a maximum radial dimension (ka) of 0.28.

In accordance with one aspect of the disclosure, an electrically small spherical helix antenna is disposed over a ground plane. The antenna achieves miniaturization through inductive loading (spiraling of the traces) and its hemispherical shape provides maximum inductance for a given volume. A radiation resistance of close to 50 Ohms can be achieved through the use of multiple arms (traces).

With reference now to the drawing figures, FIG. 1 depicts one example of a helical antenna 20 fabricated via the disclosed processes and designed to address the challenges typically presented by electrically small dipole antennas. The helical antenna 20 is formed over the upper half of a hemispherical substrate 22 with a desired number of arms 24 and a desired number of turns per arm. All but one of the arms 24, which is used as the feed, are connected to a ground plane (not shown) at respective bond pads 26. The radiation pattern of the resulting electrically small spherical helix antenna 20 is similar to that of a conventional dipole antenna.

The exemplary antenna 20 shown in FIG. 1 is a hemispherical antenna having a radius of about 2 cm and six folded arms 24 with two turns per arm 24. It is designed to operate at 1 GHz. The height of the antenna 20 may be about 9 mm. The gold (Au) printed arms 24 may have a width of about 200 μm and a thickness of about 3 μm. Increasing the number of turns of the antenna 20 decreases the resonant frequency due to the increased antenna inductance. Adding additional arms 24 only slightly modifies the resonant frequency of the antenna 20, but noticeably increases its radiation resistance.

In one example, the antenna 20 is printed onto the upper portion of a hemisphere instead of an entire hemisphere to simplify fabrication. In one exemplary case, the substrate 22 is a 0.5 mm thick glycol-modified polyethylene terephthalate (PETg) hemispherical shell, which has a measured relative permittivity $\in_r$ of 2.92 at 10 GHz.

FIGS. 2-5 depict examples of fabrication processes that may be implemented to produce the antenna design of FIG. 1. In some cases, the steps of the fabrication process are shown with multiple schematic illustrations of each step for convenience in illustrating the various steps, layers and components, as well as illustrating alternatives in design and other details. For example, in FIG. 4, a stamping sequence of steps is shown in triplicate to depict additional fabrication details (e.g., an "apply pressure" step), label components (e.g., Aluminum mold), show different trace designs, and depict components via both shading (as in the top and bottom rows) or line-drawn elements (as in the middle row).

FIG. 2 depicts the preparation of a stamp used for depositing antenna traces in a subsequent stamping sequence. In one example, a flat polydimethylsiloxane (PDMS) stamp is made using a silicon master 28 configured as a two-dimensional (2D) "negative" version of the pattern to be printed onto the curved antenna substrate. In other words, the pattern that is etched into the Si wafer corresponds to the final pattern desired on the contoured antenna substrate. More specifically, the stamp includes raised edges wherever lines are to be printed. The edges may form trenches having a desired height, such as 15 μm or 60 μm.

In one example, the Si master 28 is made by etching a 30 μm deep pattern into a Si wafer. A Polydimethylsiloxane (PDMS) mixture 30 may be prepared by combining PDMS pre-polymer and a curing agent at an 8:1 weight ratio. The PDMS mixture 30 is then poured into the Si mold 28 and cured at 100 C for 2 hours to form a PDMS 32 stamp. As shown in the sequence steps depicted in FIG. 2, when the PDMS stamp 32 is peeled from the Si master 28, it retains the pattern of the Si master 28. As also shown in the FIG. 2 sequence, the PDMS stamp 32 is then coated with a metallic layer 34 (e.g., 10 nm thick Au layer) by vacuum thermal or electron beam evaporation.

As described below, the PDMS stamp 32 is then drawn by vacuum into a 3D contour mold 36, the same 3D contour mold which is used to shape the antenna substrate. The 3D contour mold 36 may be an aluminum (Al) mold.

Figure 3:
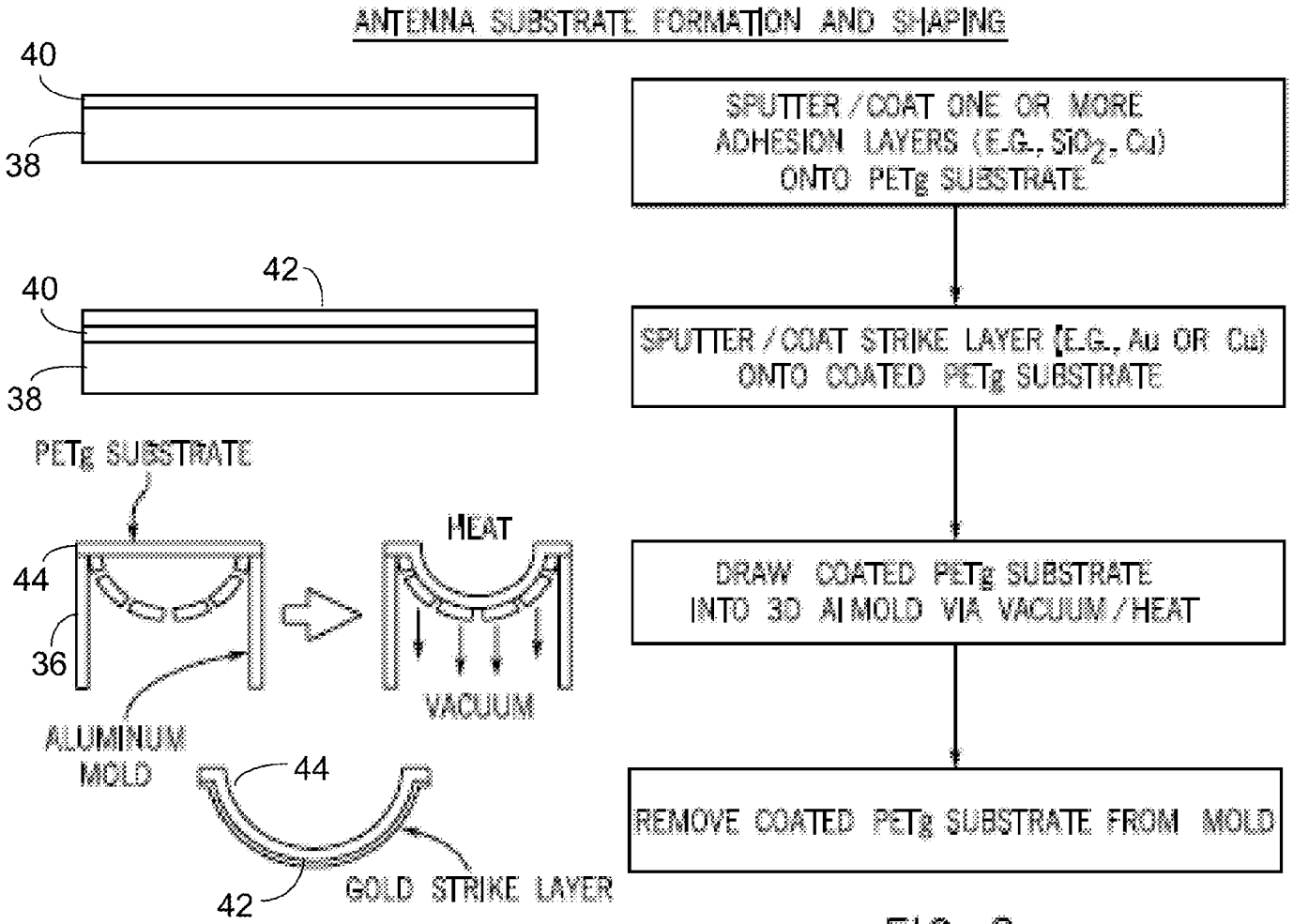

FIG. 3 depicts the sequence steps to form the hemispherical substrate of the antenna. To create a curved antenna substrate, a flat piece 38 of glycol-modified polyethylene terephthalate (PETg) is brought into the aluminum (Al) mold 36 by heating it to 140 C (above its softening temperature), and a vacuum is applied through holes predrilled into the Al mold 36. In one example, the flat piece 36 of PETg is brought into a 2 cm radius hemispherical Al mold by heating it to 140 C. Adhesion and strike layers 40, 42 may be deposited on the PETg piece 38 before deformation. For example, the PETg piece 36 may be coated with a 2 nm thick chromium (Cr) adhesion layer, and a 6 nm gold (Au) "strike" layer using vacuum thermal or electron beam evaporation to form a PETg antenna substrate 44. In another example, a 100 nm Silicon dioxide layer, a 1 nm Cr adhesion layer, and a 7 nm Au "strike" layer are added to the curved PETg substrate by a sputter coater. In other examples, a copper (Cu) layer (e.g., 3 nm Cu) may be used as an alternative or additional adhesion layer. The metallic coating on the PDMS stamp (described above) may be added using the same evaporation process. In one example, the PDMS stamp has a 15 nm Au layer added in this fashion.

The disclosed fabrication methods may use a variety of one or more metals for the strike layer. For example, the strike layer may include gold, copper, silver, or aluminum.

Figure 4:
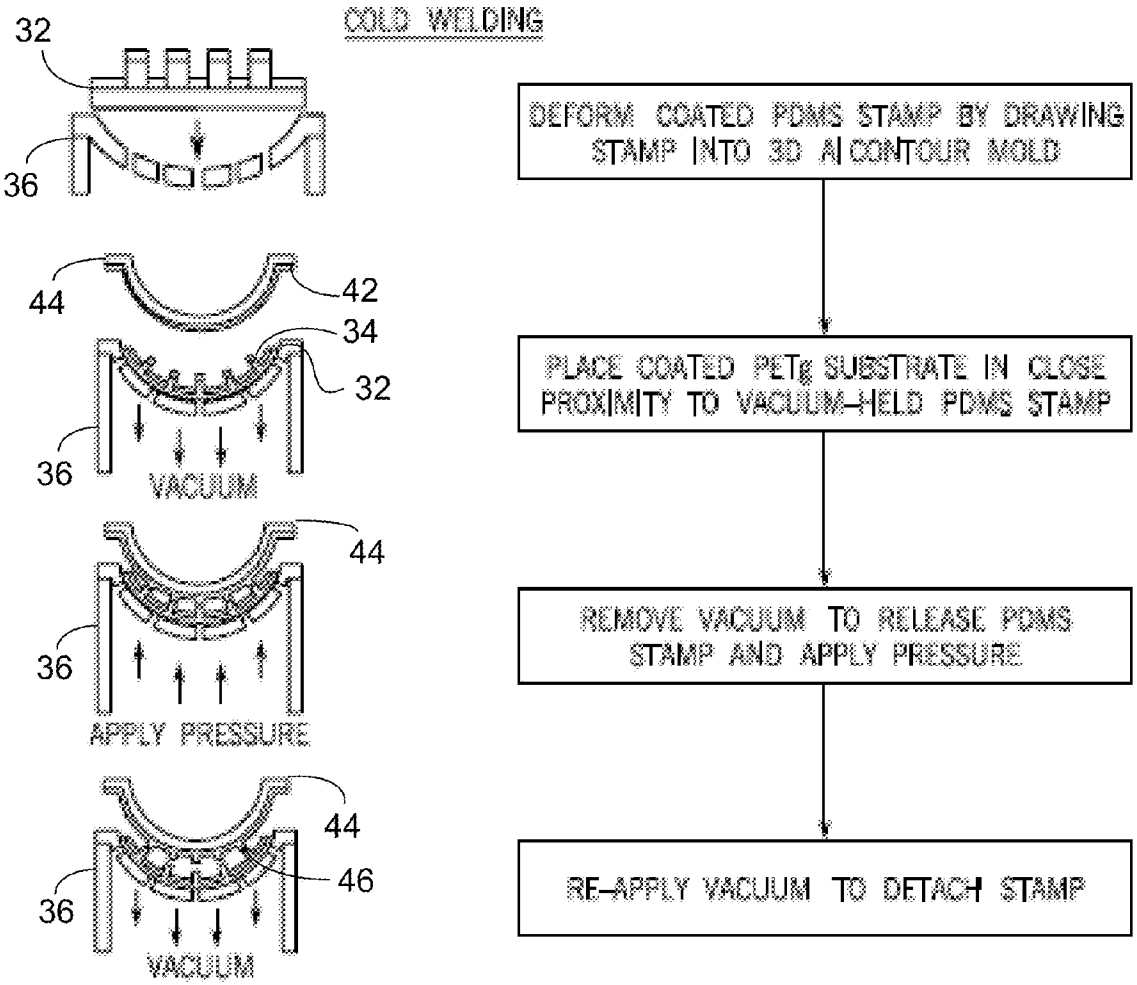

A stamping sequence of steps is shown in FIG. 4. The pattern on the PDMS stamp 32 is transferred, or stamped, via cold weld bonding onto the PETg substrate 44. To this end, the PDMS stamp 32 is first drawn into the same Al mold 36 that was used to deform the PETg substrate 44. Then the PETg substrate 44 is brought in close proximity to the PDMS stamp 32. The vacuum is then released and pressure is applied to the back of the PDMS stamp 32. This sequence allows a cold welded, metallic bond to form between the Au (or other metal) layer 34 on the PDMS stamp 32 and the Au (or other metal) strike layer 42 on the PETg substrate 44. When the vacuum is reapplied, metal lines or traces 46 (e.g., 15 nm thick traces) are transferred from the stamp 32 onto the strike layer 42 of the PETg substrate 44. The stamped metal lines 46 are disposed in locations that correspond to the positions where the stamp 32 had raised edges. The stamped metal lines 46 are more clearly shown in FIG. 5.

The cold weld bonding described above is not limited to transfers of gold to the hemispherical substrate. Strike layers of one or other metals (e.g., copper) may be positioned in close proximity to the deformed PDMS stamp.

Figure 5:
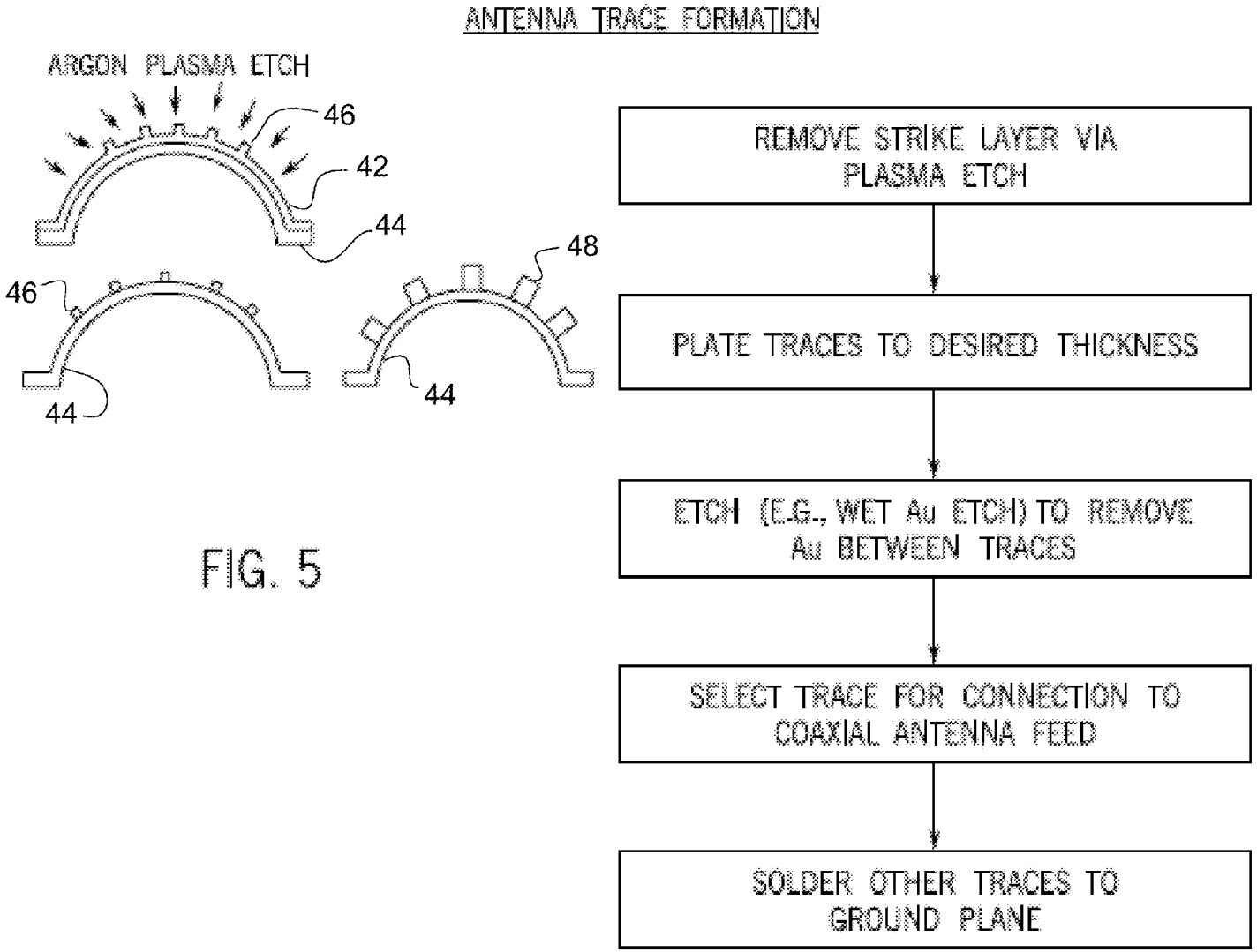

FIG. 5 depicts the etching or removal of the strike layer 42 and formation of the antenna traces at a desired thickness. More specifically, the strike layer 42 may be removed by sputtering the PETg substrate 44 in Ar plasma, leaving behind the stamped lines 46. Another possible technique for removing the strike layer 42 is through a wet Au etch. Finally, the stamped lines 46 are electroplated to the desired thickness to form antenna traces 48. For example, the lines 46 may be Au-plated to increase their thickness to, for example, about 3 μm, about 7 μm, or any thickness in the range therebetween. In this example, five of the six resulting arms (or traces) may then be soldered to a ground plane, and the sixth arm is fed with a coaxial probe.

As described below, in some cases, the PETg substrate may also be Au (or otherwise) etched once more to remove unwanted Au (or other metal) that is deposited between the stamped lines 46.

Further details regarding an exemplary sequence to fabricate a printed antenna on a 3D contoured or curved dielectric substrate in accordance with the disclosure are listed below:

1. Prepare the PDMS stamp and PETg substrate for stamping.

a) Use a standard photolithography process to etch an approximately 30 μm deep pattern into a Si (silicon) "master" wafer. The Si master pattern corresponds to the desired metallic pattern of the antenna.

b) Mix polydimethylsiloxane (PDMS) prepolymer and a curing agent at an 8:1 weight ratio. Degass the mixture for 1 hour to remove air bubbles. Fold aluminum foil around the edge of the Si master to form a "boat" that stops the PDMS from flowing off the Si wafer. For a 4" Si wafer, pour between about 3 g to about 9 g of the PDMS mixture onto the Si master. The PDMS should be about 0.5 mm to about 1.5 mm thick.

c) Bake the Si master at 100 C for 2 hours to cure the PDMS, and then peel the PDMS off the Si master. The PDMS stamp now has a pattern transferred from the master.

d) To deform the antenna substrate, bring a flat piece of glycol-modified polyethylene terephthalate (PETg) into an Al mold by heating it to 140 C (above its softening temperature), and apply a vacuum through holes pre-drilled into the Al mold.

e) Deposit a 1 nm Cr adhesion layer and 7 nm Au "strike" layer onto the curved PETg substrate through vacuum thermal or electron beam evaporation. In an alternative embodiment, deposit 30 nm $SiO_2$ and 3 nm Cu adhesion layers instead of the Cr adhesion layer.

f) Deposit 15 nm of Au onto the PDMS stamp through vacuum thermal or electron beam evaporation.

2. Bring the PDMS stamp into the same vacuum that was used to deform the PETg substrate, and place the PETg substrate close to the PDMS stamp.

3. Release the vacuum and apply 20 PSI of pressure onto the back of the PDMS stamp. A cold welded metallic bond forms between the Au on the PDMS stamp and the Au strike layer on the PETg substrate. In essence, the Au traces from the PDMS are stamped onto the substrate.

4. Reapply the vacuum to separate the PETg substrate from the PDMS stamp, leaving a 15 nm Au pattern on top of the strike layer of the PETg substrate.

5. Remove the strike layer on the PETg that is not covered by the 15 nm Au pattern through sputtering using a 30 sccm, 20 Torr, 80 W Ar plasma etch for 6 minutes. In an alternative embodiment, the sputtering act may be implemented at 30 m Torr, with the Ar plasma etch at 150 W, for about 70 seconds.

6. Gold plate the traces to the desired thickness using a standard electroplating process.

7. Option regarding the PETg substrate—further Au etching to remove unwanted Au that appears between the desired traces.

Further details regarding some of the fabrication steps described above are set forth in connection with the fabrication of focal plane detector arrays. Please see X. Xu, et al., "Direct transfer patterning on three dimensionally deformed surfaces at micrometer resolutions and its application to hemispherical focal plane detector arrays," Organic Electronics, vol. 9, no. 6, pp. 1122-1127 (December 2008), the entire disclosure of which is hereby incorporated by reference. Certain aspects of the exemplary fabrication process described above build upon the direct transfer patterning process reported in the above-referenced Xu paper, which allows patterns of 15 nm thick metallic traces to be printed onto curved substrates. That is, the printed metallic traces in the above-referenced Xu paper were only previously used for focal plane detector arrays, whereas the disclosed processes modify the technology for fabrication of 3D contoured antennas. Although 15 nm thick metallic traces are acceptable in the context of detector arrays, antenna designs use traces roughly 100-500 times thicker (multiple skin depths thickness) for efficient operation at microwave frequencies. Thus, one aspect of the disclosed antenna fabrication processes that differs from those described in the Xu paper involves the above-described plating (or electro-plating) in which the metallic lines are formed to the desired thickness. The resulting antenna traces may thus have a thickness on the order of microns of microns, e.g., a thickness greater than about 1 μm. In some cases, the thickness may exceed 10 μm. To allow for electroplating, the disclosed fabrication methods may use 50 nm SiO2 and 3 nm Cu adhesion layers, rather than the 2 nm Cr adhesion layer described in the above reference Xu paper. Further aspects of the disclosure that differ from the Xu paper involve techniques directed to allowing the gold (or other metal) traces to be plated to greater thicknesses. Further details regarding these techniques are set forth below.

Figure 6:
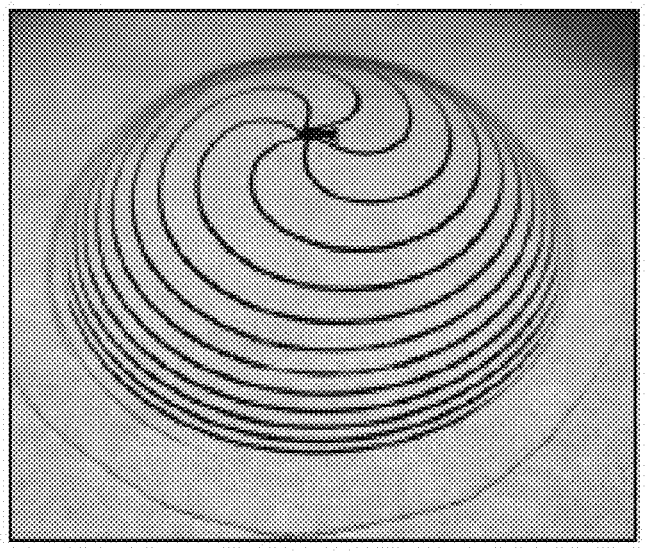
FIG. 6 is a photograph of an exemplary metallic helical pattern stamped onto a hemispherical substrate after a gold plating and a wet gold etch. The pattern includes a set of metallic traces having a thickness of 2 micrometers.
Figure 7A:
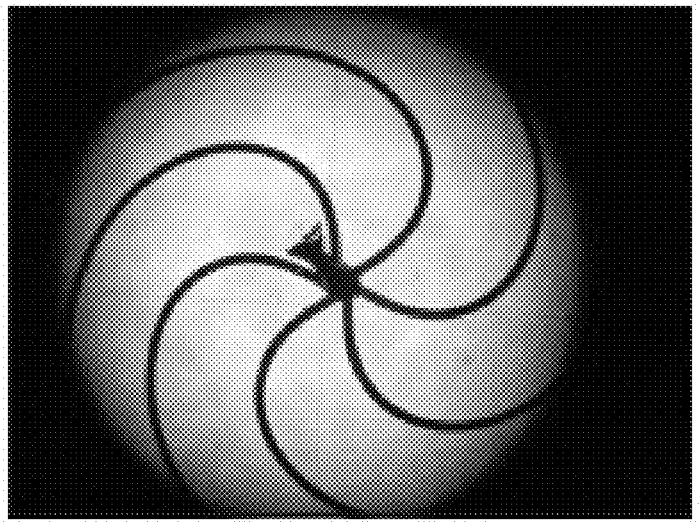
FIGS. 7A and 7B are photographs of a printed helical pattern (like the example of FIG. 6) as viewed under a microscope to depict silver epoxy used to bond the gold traces to a cathode to support a gold plating step in accordance with one or more aspects of the disclosure.
Figure 7B:
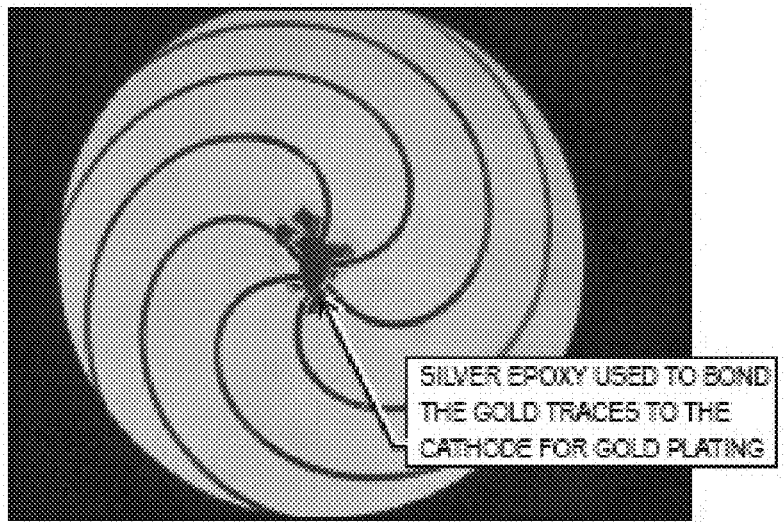

The photographs of FIGS. 6, 7A, and 7B show antennas fabricated via the above-described process. The traces are 2 micrometers thick. The detailed views via microscope reveal silver epoxy used to bond the gold traces to the cathode for the above-described gold plating step.

Figure 8A:
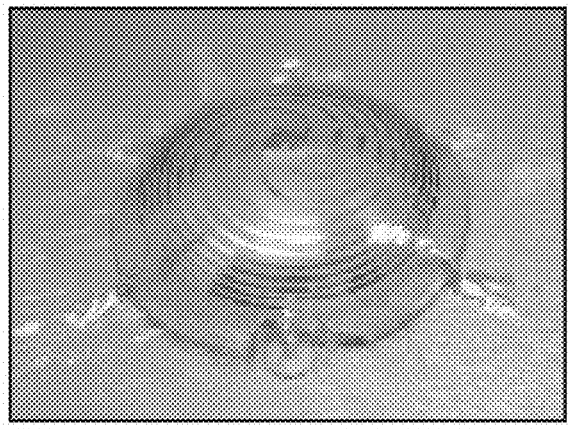
FIGS. 8A-8C are photographs of an antenna after attachment to a coaxial probe and a ground plane (FIG. 8A), before attachment to the ground plane (FIG. 8B), and as viewed under a microscope to depict the silver epoxy used for gold plating (FIG. 8C).
Figure 8B:
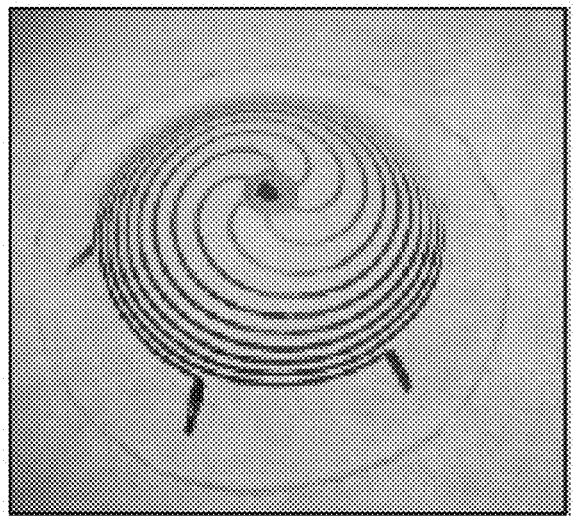
Figure 8C:
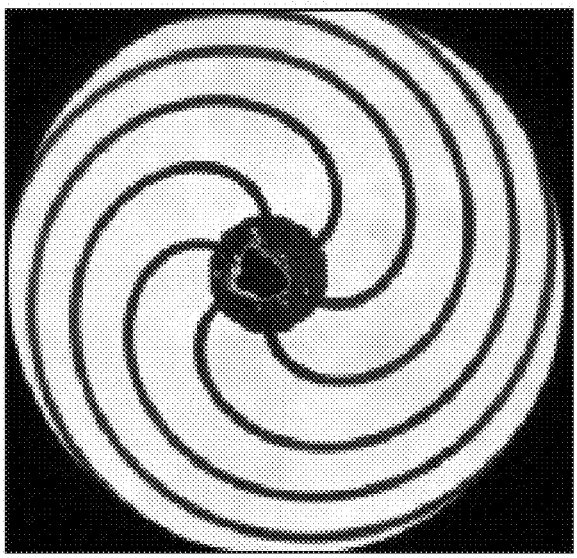

The photographs of FIGS. 8A-8C show further antennas fabricated via the above-described process, including before and after attachment of traces to a ground plane.

Figure 9A:
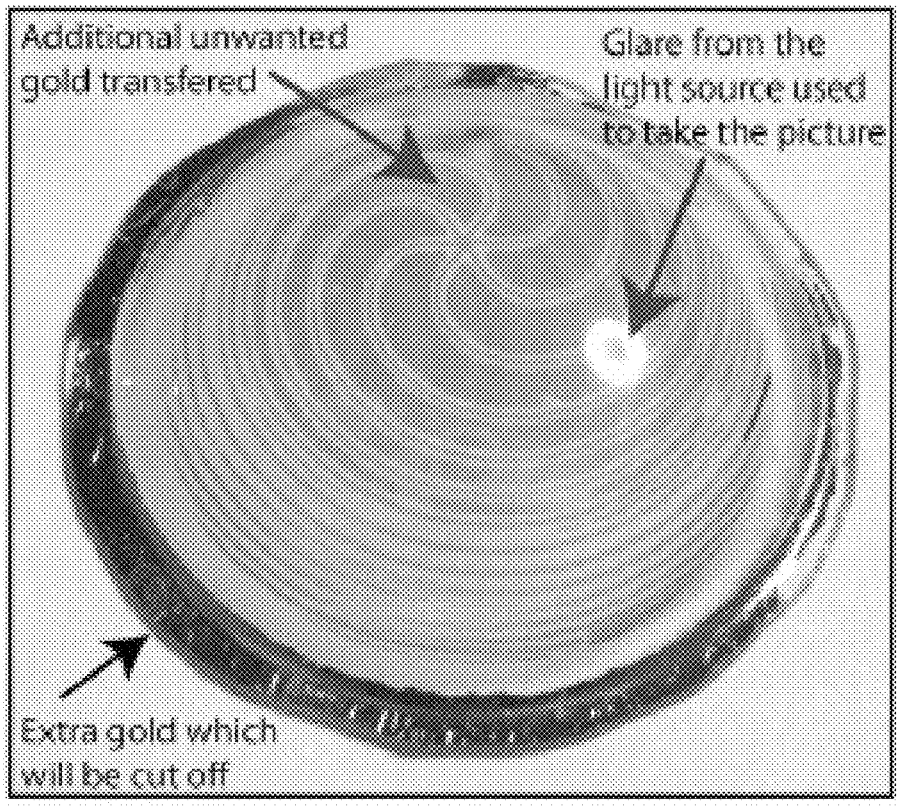
FIGS. 9A and 9B are photographs of a PETg antenna substrate directly after plasma etching to depict unwanted, extra gold that has been transferred between the desired traces during the stamping process (in the upper portion of the antenna, where the traces are relatively far apart), but not transferred between the traces where the traces are closer together (in the lower portion of the antenna).
Figure 9B:
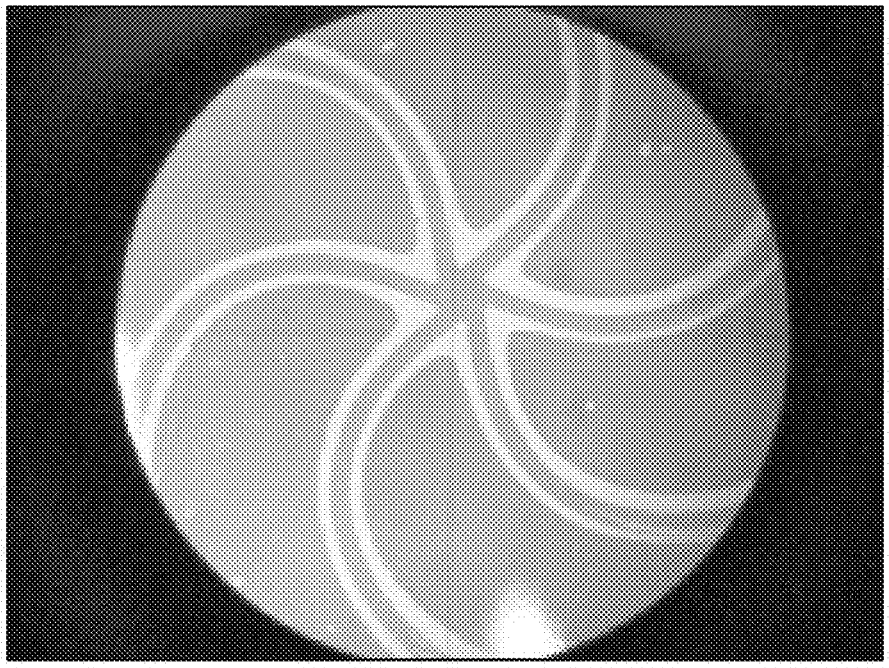

FIGS. 9A and 9B are photographs showing a challenge addressed by the disclosed processes involving the spurious deposition of gold between the traces. When the desired pattern has large gaps between the traces (a "sparse trace pattern"), unwanted Au from the PDMS stamp will transfer to the PETg substrate during the stamping process sequence. This problem occurs because the PDMS stamp is a fairly flexible material. When pressure is applied to the back of the PDMS to stamp the pattern onto the PETg substrate, the stamp bends to conform to the surface of the PETg substrate. The schematic view shown in FIG. 10 demonstrates how this happens when a As shown in FIG. 10, there are gaps 50 between desired traces 52 (e.g., Au traces) and a region 54 of unwanted Au (or other metal) on a PETg substrate 56. The unwanted Au region 54 results from the deformation of a PDMS stamp 58 during the stamping process. However, due to the gaps 50, an unexpected benefit of the subsequent plating step is that only the desired metallic traces 52 are plated during the electroplating process, given that there is no electrical connection between the desired traces 52 and the unwanted Au region 54. Later, the unwanted Au region 54 may be removed using a simple wet Au etch process, as shown in FIG. 10.

FIGS. 11A and 11B are photographs of exemplary helix antennas fabricated via the disclosed methods. Both of the helix antennas are disposed on a substrate having a shape that corresponds with the top half of a hemisphere. The antenna of FIG. 11A has six, copper-plated arms, each with 1.5 turns, while the antenna of FIG. 11B has four gold-plated arms, each with one turn. The antenna of FIG. 11A has operating frequency at or near 782 MHz, while the antenna of FIG. 11B has an operating frequency at or near 1.16 GHz. Performance tests of the antennas revealed ka, Q, and efficiency values of 0.26, 4.7*Chu limit, and 35% (FIG. 11A), and 0.40, 5.1*Chu limit, and 57% (FIG. 11B).

FIGS. 12A and 12B are photographs of further exemplary helix antennas fabricated via the disclosed methods. Both of the helix antennas are disposed on a full hemisphere substrate (as opposed to the top-half hemisphere substrates of the examples of FIGS. 11A and 11B). The antenna of FIG. 12A has four, gold-plated arms, each with 1.5 turns, while the antenna of FIG. 12B has three gold-plated arms, each with one turn. The antenna of FIG. 12A has operating frequency at or near 1.12 GHz, while the antenna of FIG. 12B has an operating frequency at or near 1.52 GHz. Performance tests of the antennas revealed ka, Q, and efficiency values of 0.23, 2.1*Chu limit, and 52% (FIG. 12A), and 0.31, 1.8*Chu limit, and 69% (FIG. 12B).

As shown in FIGS. 11A, 11B, 12A, and 12B, the disclosed methods may be used to fabricate efficient and relatively broadband electrically small antennas. In FIGS. 11A and 11B, the spherical helix antennas printed on the top half of a hemisphere have traces with a thickness of 12 μm for the copper plated antenna (FIG. 11A) and 5 μm for the gold plated antenna (FIG. 11B). In FIGS. 12A and 12B, the spherical helix antennas printed onto the entire hemisphere have traces with a thickness of 7 μm. The Q factors of all these antennas are fairly close to the minimum achievable limit known as the Chu limit.

The disclosed processes generally address several challenges presented by the fabrication of 3D contoured antennas. One challenge involves the plating of gold on a curved surface. Printed metallic lines on a curved surface have not been gold plated because the metallic traces cannot be gold plated if their adhesion to the curved substrate is insufficient. Generally speaking, the traces may not properly adhere to the substrate, thereby falling off during the gold plating process. The disclosed processes address this challenge by sputtering Silicon dioxide and copper onto the PETg surface prior to depositing the Au strike layer. There is a stronger adhesion of Au to Silicon dioxide and copper than that of Au to PETg, which makes it possible to gold plate thicker traces. The use of pyrex glass as a substrate instead of PETg may allow even thicker traces to be plated. In addition, the technique of pulse plating may be useful for plating greater thicknesses. Copper plating may be used to allow even thicker traces to be plated. With an antenna fabricated by printing metallic traces on a curved substrate using direct transfer patterning, a significant benefit of the disclosed processes is the ability to fabricate complex antenna shapes. Without the ability to fabricate thick metallic traces on curved substrates, printed antenna designs are otherwise restricted to relatively simple 3D antenna shapes because such designs were fabricated manually rather than through photolithography.

The design and fabrication of an electrically small spherical helix antenna has been described above. The antenna may be fabricated using a direct transfer patterning process that avoids the drawbacks generally presented by past fabrication techniques. The process of printing metallic traces over a contoured substrate allows the fabrication of hemispherical antennas that address the challenges of electrically small antennas. Despite the advantages of spherical helix antennas, the disclosed process may nonetheless be applied and adopted to fabricate contoured antennas with other antenna topologies. Indeed, the disclosed processes may be used with a variety of different substrates and substrate contours. Moreover, the disclosed processes are also not limited to electrically small antennas, and may be used to fabricate, for example, wavelength-scale, multi-wavelength antennas, or antenna arrays.

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

The foregoing description is given for clearness of understanding only, and no unnecessary limitations should be understood therefrom, as modifications within the scope of the invention may be apparent to those having ordinary skill in the art.

What is claimed is:

1. A method of fabricating an antenna, the method comprising:

forming a flexible stamp from a first mold, the first mold transferring a pattern to the flexible stamp;

shaping an antenna substrate into a three-dimensional contour with a second mold;

positioning the flexible stamp in the second mold to deform the flexible stamp into the three-dimensional contour; and cold welding a metallic layer on the flexible stamp to create a set of antenna traces on the antenna substrate in accordance with the pattern.

2. The method of claim 1, further comprising etching unwanted metal disposed between the antenna traces.

3. The method of claim 1, wherein the antenna substrate comprises glass.

4. The method of claim 1, wherein the antenna substrate comprises glycol-modified polyethylene terephthalate (PETg).

5. The method of claim 1, wherein the antenna substrate comprises a dielectric material.

6. The method of claim 1, further comprising electroplating the metallic layer to thicken the antenna traces.

7. The method of claim 6, wherein electroplating the metallic layer comprises pulse plating.

8. The method of claim 6, wherein the metallic layer on the flexible stamp comprises gold and wherein electroplating the metallic layer comprises depositing copper onto the gold.

9. The method of claim 1, wherein the first mold comprises a wafer.

10. The method of claim 1, wherein the second mold comprises a vacuum mold.

11. The method of claim 1, wherein cold welding the metallic layer comprises applying the metallic layer to a metallic strike layer on the antenna substrate.

12. The method of claim 11, further comprising sputtering Silicon dioxide onto a surface of the antenna substrate before deposition of the metallic strike layer.

13. The method of claim 11, further comprising sputtering Silicon dioxide and copper onto a surface of the antenna substrate before deposition of the metallic strike layer.

* * * * *